US008469185B2

(12) United States Patent
Nicoletti

(10) Patent No.: US 8,469,185 B2
(45) Date of Patent: Jun. 25, 2013

(54) PACKAGING STRUCTURE OF CONTAINERS FOR PHARMACEUTICAL USE

(76) Inventor: Fabiano Nicoletti, Mira (IT)

( * ) Notice: Subject to any disclaimer, the term of this patent is extended or adjusted under 35 U.S.C. 154(b) by 0 days.

(21) Appl. No.: 13/146,187

(22) PCT Filed: Jan. 25, 2010

(86) PCT No.: PCT/EP2010/000412

§ 371 (c)(1),
(2), (4) Date: Jul. 25, 2011

(87) PCT Pub. No.: WO2010/086128

PCT Pub. Date: Aug. 5, 2010

(65) Prior Publication Data

US 2011/0277419 A1 Nov. 17, 2011

(30) Foreign Application Priority Data

Jan. 27, 2009 (IT) ..... MI2009A0086

(51) Int. Cl.

| | |
|---|---|
| ***B65D 1/36*** | (2006.01) |
| ***B65D 75/00*** | (2006.01) |
| ***B65D 85/20*** | (2006.01) |
| ***A47F 7/00*** | (2006.01) |

(52) U.S. Cl.
USPC ..... 206/203; 206/427; 206/443; 211/74; 220/518

(58) Field of Classification Search
USPC ..... 206/203, 370, 427, 432, 438, 439, 206/443, 562–564; 422/22, 23, 300–304, 422/28; 53/425, 434, 474; 220/516–518; 211/74
See application file for complete search history.

(56) References Cited

U.S. PATENT DOCUMENTS

| | | | | |
|---|---|---|---|---|
| 3,148,797 | A * | 9/1964 | Cloyd | 220/516 |
| 4,523,679 | A * | 6/1985 | Paikoff et al. | 206/370 |
| 5,165,539 | A | 11/1992 | Weber et al. | |
| 6,164,044 | A * | 12/2000 | Porfano et al. | 422/28 |
| 6,193,064 | B1 * | 2/2001 | Finneran | 206/443 |
| 7,100,768 | B2 * | 9/2006 | Grimard et al. | 206/438 |
| 7,296,678 | B2 * | 11/2007 | Raynal-Olive et al. | 206/439 |
| 7,428,807 | B2 * | 9/2008 | Vander Bush et al. | 53/425 |
| 2006/0016156 | A1 * | 1/2006 | Bush et al. | 53/434 |
| 2008/0314771 | A1 * | 12/2008 | Barbalho et al. | 206/203 |

FOREIGN PATENT DOCUMENTS

| | | | |
|---|---|---|---|
| DE | 7617706 | U1 | 11/1976 |
| DE | 2627012 | A1 | 12/1977 |
| FR | 2911072 | A1 | 7/2008 |

OTHER PUBLICATIONS

International Search Report of PCT/EP2010/000412 dated Jun. 2, 2010.
Written Opinion of the International Searching Authority of PCT/EP2010/000412 dated Jun. 2, 2010.

* cited by examiner

*Primary Examiner* — Bryon Gehman
(74) *Attorney, Agent, or Firm* — Amster, Rothstein & Ebenstein LLP

(57) ABSTRACT

A packaging structure of containers for pharmaceutical use including a main body in plastic having a bottom and side walls, positioning pins and partitions for predetermined spatial positioning of the containers, and a lid applied for closing the main body. The lid includes a membrane selectively permeable to a sterilising fluid suitable to sterilize the containers.

11 Claims, 3 Drawing Sheets

PACKAGING STRUCTURE OF CONTAINERS FOR PHARMACEUTICAL USE

The present invention relates to a packaging structure of containers for pharmaceutical use.

Conventional packagings for containers for pharmaceutical use generally simply comprise a box-type body into which the containers are inserted, and a lid to close the box-type body, removable once the packaging has reached its destination at the pharmaceutical company for extraction of the containers, which must undergo washing and sterilisation before being filled with the medicinal product and capped.

The management of packagings at the pharmaceutical company is extremely complicated due to the fact that, as mentioned, the containers must be manipulated and conveyed through complex, costly and bulky washing and sterilisation systems before being finally filled.

The technical aim of the present invention is, therefore, to produce a packaging structure of containers for pharmaceutical use that permits the aforesaid technical problems of prior art to be overcome.

Within this technical aim an object of the invention is to produce a packaging structure of containers for pharmaceutical use suitable to provide pharmaceutical companies with pre-washed and sterilized containers ready to be filled.

Another object of the invention is to produce a packaging structure of containers for pharmaceutical use suitable to permit automated manipulation of the containers.

Another object of the invention is to produce a packaging structure of containers for pharmaceutical use suitable to ensure improved protection of the containers during transport.

Another object of the invention is to produce a packaging structure of containers for pharmaceutical use which permits sterilisation of the containers and maintenance of the sterility of the containers.

Yet another object of the invention is to produce a packaging structure of containers for pharmaceutical use which is both extremely simple and highly functional.

The technical aim, and these and other objects according to the present invention are achieved by producing a packaging structure of containers for pharmaceutical use according to claim 1.

The packaging structure in conformity with the present invention has an extremely simple production process given that the box-type body can be produced in a single moulding operation.

A specific insert in the mould also allows the box-type body to be adapted to containers for pharmaceutical use of different height.

The bottom of the box-type body is preferably designed in order to offer the necessary mechanical resistance to withstand the thrust created by a capping system operating directly on the containers placed in their positioning seats created in the box-type body.

The selectively permeable membrane has characteristics suitable for passage in the two directions of a sterilising agent but not of polluting agents of other kind.

The positioning means permit a robotic manipulator to know the spatial coordinates of each container and consequently permit their automated manipulation, saving time and reducing the risk of erroneous and potentially damaging movements typical of human nature.

Robotic manipulation of the content of the packaging can be facilitated by a perimeter step of the box-type body which, determining an enlargement of the upper part of the packaging, facilitates grip.

Furthermore, other characteristics of the present invention are defined in the subsequent claims.

Further characteristics and advantages of the invention shall be clearer from the description of preferred but not exclusive embodiments of the packaging structure of containers for pharmaceutical use according to the invention, illustrated for indicative and non-limiting purposes in the accompanying drawings, wherein.

Figure 5:
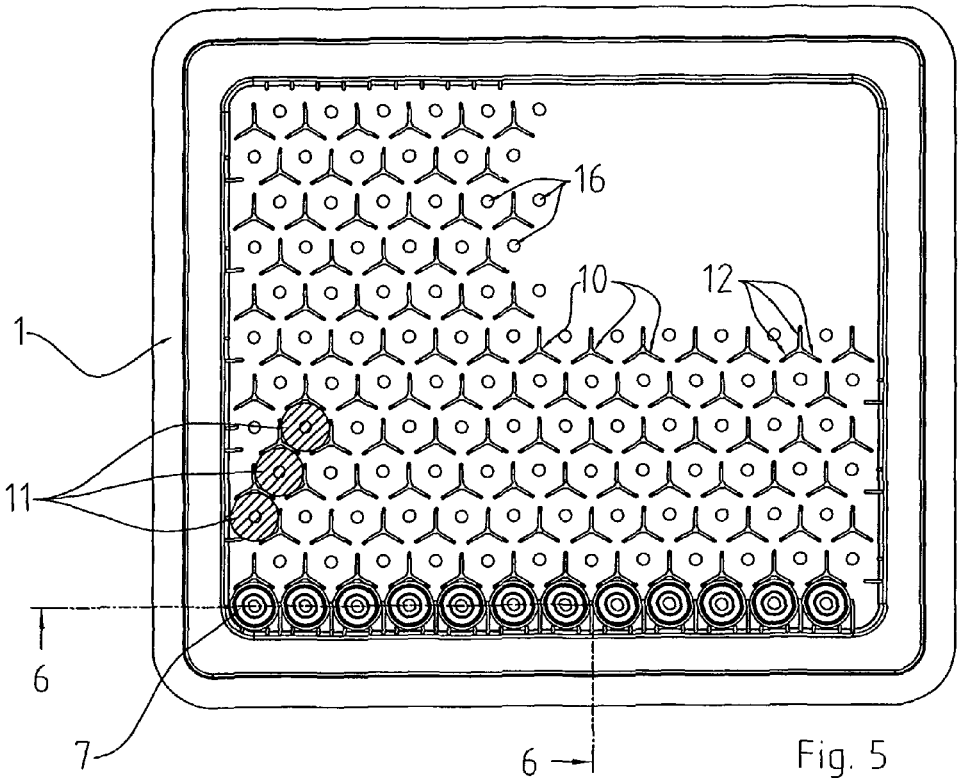
Figure 6:
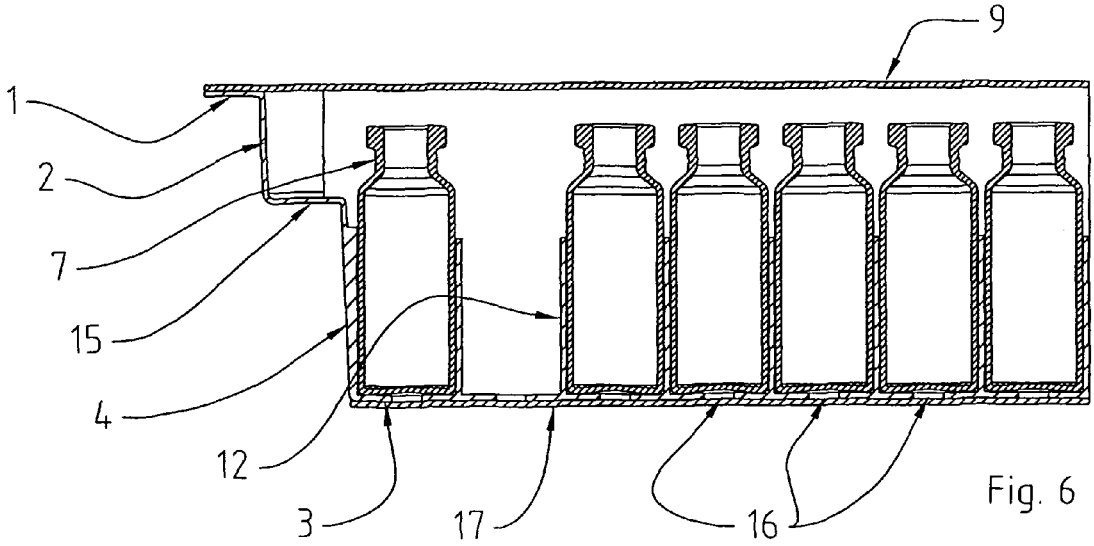

FIG. 5 shows a plan view of a packaging structure in conformity with a third preferred embodiment of the invention, which differs from the first solely through the structure of the bottom of the box-type body which is perforated and coated with a membrane selectively permeable to the sterilising agent; and FIG. 6 shows a side elevational view of the packaging structure of FIG. 5 sectioned along the line 5-5.

Identical parts in the various embodiments will be indicated with the same reference number.

With reference to the aforesaid figures, a packaging structure of containers for pharmaceutical use is shown, indicated as a whole with the reference number 1.

The packaging structure 1 comprises a box-type body 2 in plastic with a bottom 3 and side walls 4.

Means for predetermined spatial positioning of the containers 7 are produced in a single piece with the box-type body and internally thereto.

The box-type body 2 is closed with a lid comprising a membrane 9 of a material selectively permeable to a sterilising agent suitable to sterilise the containers 7.

The lid is preferably composed of a sheet detachably bound, i.e. by heat-sealing, along the free edge of the side walls 4 of the box-type body 2.

The positioning means instead comprise an ordered distribution of positioning pins 10 which, extending from the bottom 3 of the box-type body 2, delimit a plurality of positioning seats 11 for the containers 7.

The positioning pins 10 must be conformed and disposed in order to delimit groups of positioning seats 11, the form of which is conjugated to that of the containers 7. In this way, the containers 7 can be housed in the positioning seats 11 with precision and without being able to move laterally.

In the case in question, the positioning pins 10 are distributed with constant spacing in a plurality of rectilinear rows parallel to the two larger opposite side walls 4 of the bottom 3 of the box-type body 2 which in particular is parallelepiped shaped.

The plurality of rectilinear rows are offset from one another so that the positioning pins 10 of alternate rows are aligned in a direction parallel to the two smaller opposite side walls 4 of the bottom 3 of the box-type body 2.

The positioning pins 10 have a star-shaped cross section in particular with three wings 12 spaced equidistantly at angles of 120°.

Each positioning seat 11 occupies a prismatic volume delimited by three contiguous positioning pins 10 having as base a hexagon which inscribes the circumference of the containers 7 which particularly have a cylindrical body.

Naturally, the distribution and the shape of the positioning pins 10 can also be different from that illustrated and described.

Figure 1:
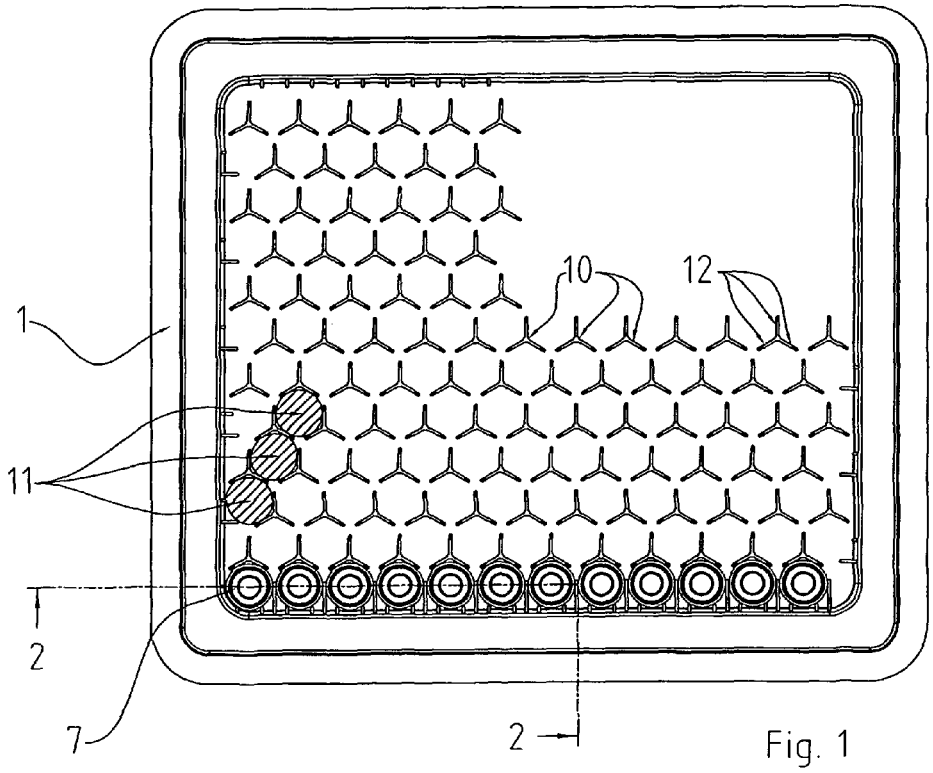
FIG. 1 shows a plan view of a packaging structure of containers for pharmaceutical use in conformity with a first preferred embodiment of the invention.

The embodiments illustrated in FIGS. 1 and 5 show the containers 7 which are resting directly on the bottom 3 of the box-type body 2 and have a height substantially equal to the height of the box-type body 2 in order to position their top in proximity of the top of the box-type body 2 to facilitate gripping by manual or robotic manipulation and/or their filling.

Optionally, the packaging structure 1 can have means for spacing the containers 7 from the bottom 3 of the box-type body 2.

These spacing means are intended to adapt the box-type body 2 to containers 7 of a height even substantially lower than its height so that the containers 7 can be positioned with their top always in proximity of the top of the box-type body 2.

Figure 3:
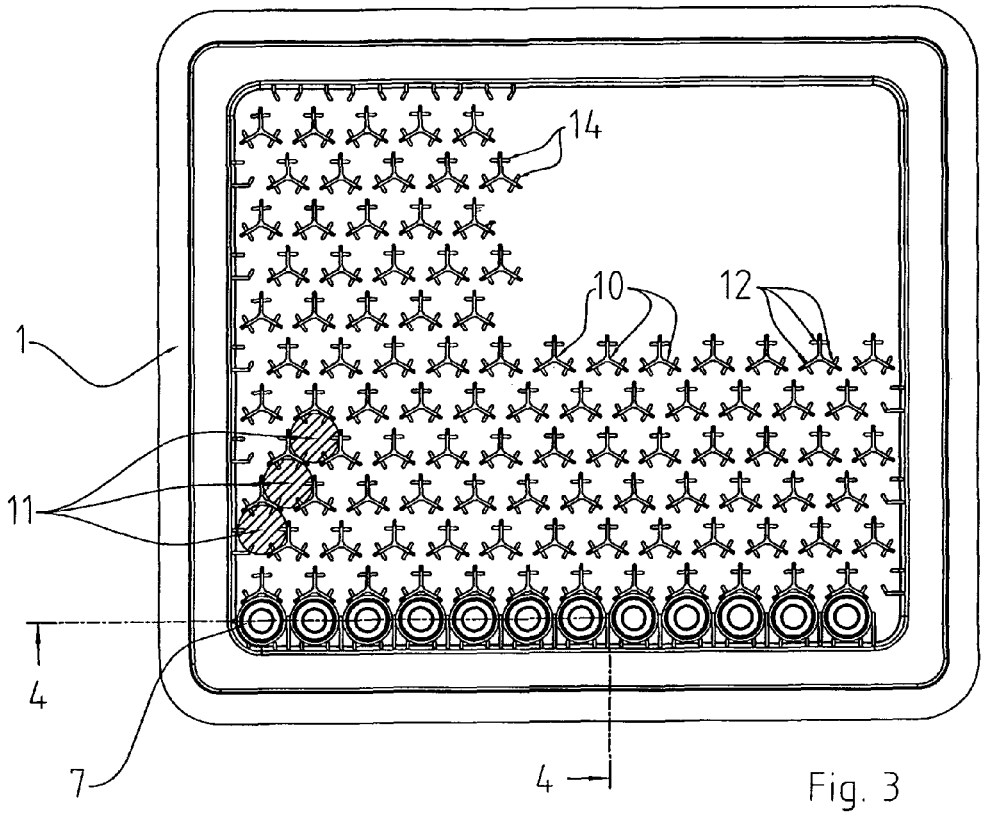
FIG. 3 shows a plan view of the packaging structure in conformity with a second preferred embodiment of the invention, and differing from the first solely through the provision in the positioning seats of spacers that permit the packaging to be adapted to containers of lesser height to that of the containers shown in FIG. 2.
Figure 4:
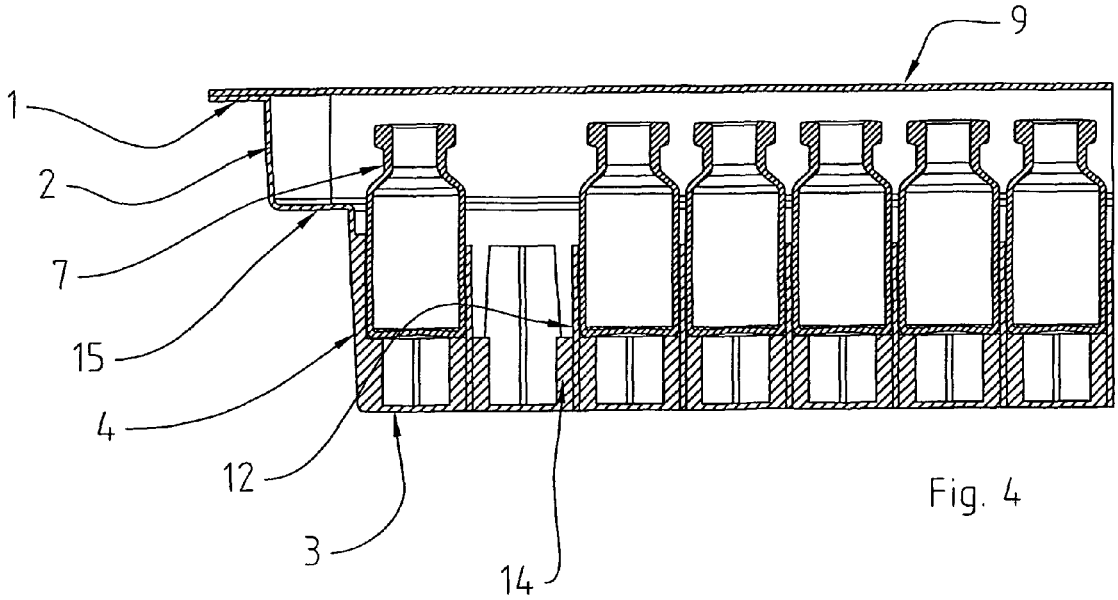
FIG. 4 shows a side elevational view of the packaging structure of FIG. 3 sectioned according to the line 4-4.

In the embodiment illustrated in FIGS. 3 and 4, the spacing means comprise forms present within the positioning seats 11.

Each form in particular consists of partitions 14 which, extending from the bottom 3 for a height substantially lower than that of the positioning pins 10, transversely intersect the wings 12 of the positioning pins 10.

The partitions 14 are designed so that the sum of their height with the height of the containers 7 must be equal substantially to the height of the box-type body 2.

Preferably, the forms are also produced in a single piece with the box-type body 2.

Figure 2:
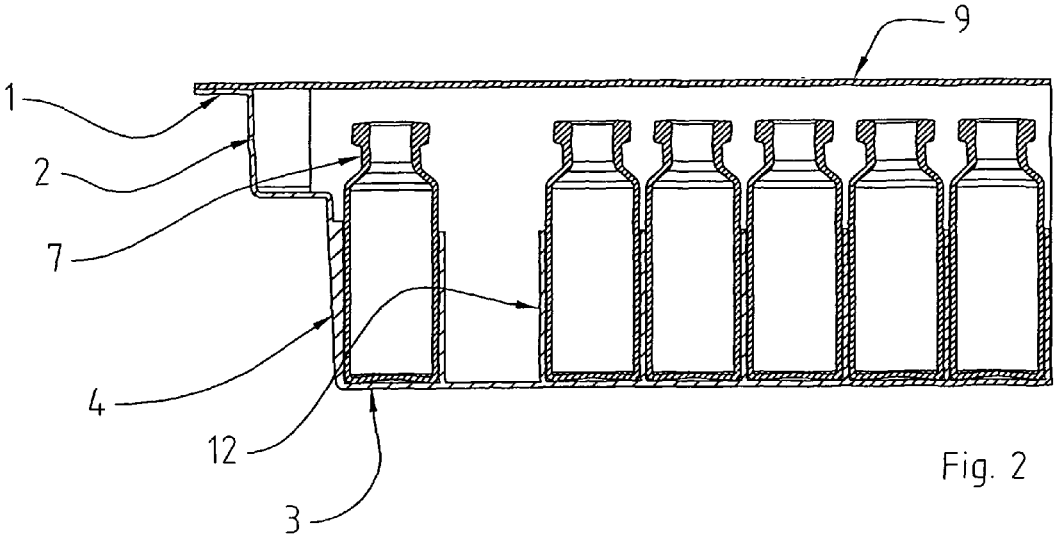
FIG. 2 shows a side elevational view of the packaging structure of FIG. 1 sectioned according to the line 2-2.

By way of example, the forms of the box-type body 2 of FIGS. 3 and 4 are produced by placing specific inserts (not shown) in the mould from which the box-type body 2 of FIGS. 1 and 2 is produced.

To facilitate gripping of the containers 7 by a manipulator, the side walls 4 of the box-type body 2, in an intermediate position thereof, have a step 15 shaped in order to enlarge the upper part of the box-type body 2.

The bottom 3 of the box-type body 2 can advantageously be produced with a thickness of plastic capable of withstanding the force required to cap the containers 7 positioned directly inside their positioning seats 11.

Moreover, although in the embodiments of FIGS. 1-4 the flow of the sterilising gent is made possible only through the lid of the top of the box-type body, to optimize productivity it is also possible, as shown in the embodiment of FIGS. 5 and 6, to provide a double flow of sterilising agent both through the lid and through the bottom 3 of the box-type body 2. For this purpose the bottom 3 has a plurality of through holes 16 and is coated with a membrane 17 selectively permeable to the sterilising fluid but not to polluting agents.

The membrane 17 is preferably of the same type as the membrane 9 and coats the outer side of the bottom 3.

In a preferred application (not shown) the through holes 16 are dimensioned in order to permit insertion therethrough of corresponding pusher means, operated from the outside of the bottom 3, in order to remove the containers 7. This is convenient in situations in which manipulation of the containers 7 from the side of the lid is more difficult.

The packaging for containers for pharmaceutical use according to the present invention is suitable to be used in order to feed, directly and automatically, the containers 7 with a predetermined spatial position to a process machine for their manipulation.

Precise positioning of the containers also permits additional operations, such as capping the containers, to be carried out directly inside the box-type body 2, with obvious advantages in terms of logistics and productivity.

It must be noted that the packaging according to the present invention permits pharmaceutical companies to be supplied with a pack of containers which on the one hand have already been washed and sterilised and do not require pharmaceutical companies to provide bulky and costly washing and sterilisation lines, and on the other, due to their precise spatial positioning inside the box-type body 2, are also suitable to be manipulated automatically for the filling and capping operations which, moreover, can also take place leaving the containers 7 directly in their positioning seats 10 inside the box-type body 2.

The packaging for containers for pharmaceutical use according to the present invention is suitable to be used to house containers for pharmaceutical use preferably in glass, such as glass bottles.

The packaging structure of containers for pharmaceutical use thus conceived is susceptible to numerous modifications and variations, all falling within the scope of the inventive concept; moreover, all the details can be substituted by technically equivalent elements.

In practice, the materials used and the dimensions can be any according to requirements and to the state of the art.

The invention claimed is:

1. A packaging structure for containers for pharmaceutical use, comprising a main body in plastic with a bottom and side walls, means for predetermined spatial positioning of containers within the packaging structure in order to feed, directly and automatically, the containers to process machines, said positioning means being formed internally and integrally formed with said main body, with a lid applied for closing said main body, and comprising a membrane of a material which is selectively permeable to a sterilizing agent, in order to sterilize the containers, said side walls in an intermediate position have a step shape in order to enlarge the upper part of said main body wherein said positioning means comprise an ordered distribution of positioning pins which, extending from said bottom of said main body, delimit a plurality of positioning seats for the containers so that a base of each positioning seat forms a hexagon, and wherein the ordered distribution of positioning pins comprises constant spacing of the positioning pins in a plurality of rectilinear rows parallel to a first pair of opposite side walls of the main body, the plurality of rectilinear row being offset from one another so that the positioning pins of alternate rows are aligned in a direction parallel to a second pair of opposite side walls of the main body.

2. A packaging structure of containers for pharmaceutical use as claimed in claim 1, characterized in that said lid is a sheet detachably bound along a free edge of said side walls.

3. A packaging structure of containers for pharmaceutical use as claimed in claim 1, characterized in that said positioning pins are conformed and disposed in order to delimit groups of said positioning seats.

4. A packaging structure of containers for pharmaceutical use as claimed in claim 1, characterised in that said positioning pins have a star-shaped cross-section.

5. A packaging structure of containers for pharmaceutical use as claimed in claim 1, further comprising means to space the containers from said bottom.

6. A packaging structure of containers for pharmaceutical use as claimed in claim 5, characterised in that said spacing means comprise formations present within said positioning seats.

7. A packaging structure of containers for pharmaceutical use as claimed in claim 6, characterised in that said formations are integrally formed with said main body.

8. A packaging structure of containers for pharmaceutical use as claimed in claim 1, characterised in that said bottom has through holes and is coated with another membrane selectively permeable to the sterilising agent.

9. A packaging structure of containers for pharmaceutical use as claimed in claim 8, characterised in that said through holes are dimensioned in order to permit insertion therethrough of corresponding pusher means operated from the outside, in order to remove the containers.

10. A packaging structure of containers for pharmaceutical use as claimed in claim 1, wherein the containers are glass containers for pharmaceutical use.

11. Use of a packaging structure for containers for pharmaceutical use as claimed in claim 1, in order to feed, directly and automatically, the containers with a predetermined spatial position to a process machine for their manipulation.

* * * * *

UNITED STATES PATENT AND TRADEMARK OFFICE

CERTIFICATE OF CORRECTION

PATENT NO. : 8,469,185 B2
APPLICATION NO. : 13/146187
DATED : June 25, 2013
INVENTOR(S) : Fabiano Nicoletti It is certified that error appears in the above-identified patent and that said Letters Patent is hereby corrected as shown below:

Title Page:

Item 73 the Assignee's name is missing and should be added as follows:

--"STEVANATO GROUP INTERNATIONAL A.S."--

Signed and Sealed this
Twenty-fourth Day of September, 2013

Teresa Stanek Rea
*Deputy Director of the United States Patent and Trademark Office*